US005235998A

United States Patent [19]

Liu

[11] Patent Number: 5,235,998

[45] Date of Patent: Aug. 17, 1993

[54] RIB STRUCTURE OF MULTIPLE-FOLD UMBRELLA

[76] Inventor: Fu-Hai Liu, Suite 1, 11F, 95-8 Chang Ping Road, Sec. 1, Taichung, Taiwan

[21] Appl. No.: 989,635

[22] Filed: Dec. 14, 1992

[51] Int. Cl.[5] ..... A45B 19/00

[52] U.S. Cl. ..... 135/25.3; 135/29; 135/31; 403/206; 403/119

[58] Field of Search ..... 135/25.3, 25.31, 25.34, 135/25.32, 26, 27, 29, 30, 31, 15.1, 25.1; 403/112, 113, 119, 65, 206, 207, 208

[56] References Cited

U.S. PATENT DOCUMENTS

| | | | |
|---|---|---|---|
| 1,474,821 | 11/1923 | Hartzell | 135/25.31 |
| 1,490,924 | 4/1924 | Hartzell | 135/25.31 X |
| 3,705,593 | 12/1972 | Weber | 135/25.3 X |
| 4,658,844 | 4/1987 | Ping | 135/25.3 |
| 4,984,599 | 1/1991 | Hwang | 135/25.3 |
| 5,063,953 | 11/1991 | Wu | 135/25.3 |
| 5,073,060 | 12/1991 | Pethers | 403/119 X |
| 5,121,764 | 6/1992 | Wu | 135/31 |
| 5,144,971 | 9/1992 | Seidel et al. | 135/25.3 X |

*Primary Examiner*—Richard E. Chilcot, Jr.
*Assistant Examiner*—Lan M. Mai

[57] ABSTRACT

A rib structure of multiple-fold umbrella having enchanced strength and allowing to be opened and closed more smoothly characterized essentially in that the outermost end of the inner intermediate main rib is formed into a bifurcated portion within which a back-up joint in U-shaped cross section is pivotally connected for fitting thereinto and the inner end of the outer intermediate main rib is pivotally connected to the back-up joint and the outermost end of the inner intermediate main rib, thereby to increase the strength of the umbrella ribs, and that a back-up resilient part is provided between the inner intermediate main rib and the intermediate linking rib or between the outer intermediate main rib and the outer linking rib such that when opening the umbrella, the ribs are straightened and stretched for smooth unfolding by means of the acting force of the back-up resilient part and linkage of the ribs before the umbrella cloth is subject to external force and, when closing, the ribs can be folded intrinsically also by means of the resilient force of the back-up resilient part.

7 Claims, 17 Drawing Sheets 10
19
17
16
18
1641
15
13
14
1
12
11

RIB STRUCTURE OF MULTIPLE-FOLD UMBRELLA

The present invention relates to a rib structure for multiple-fold umbrella and, in particular, to a rib structure having higher strength and capable of smoother opening and closing than conventional umbrella ribs.

The present invention is directed to the drawbacks found in conventional umbrella rib structures such as known from patent application No. 691,737, now U.S. Pat. No. 5,063,953, entitled "Quickly Openable Umbrella With Multiple Folds" and makes improvements to provide a rib structure which has higher strength and can be opened and closed more smoothly. In the structure as provided in the aforementioned prior art, an inner intermediate main rib of the rib assembly is formed with two sections of grooves, a downwardly-opened groove at one end and an upwardly opened groove at the other end for foldably receiving two flexible linking ribs of the rib assembly such that when opening the umbrella, the ribs can be quickly stretched open by means of operating the flexible linking rib in conjunction with other ribs so as to prevent the ribs from being twisted by external force due to the ribs stretching slowly in the process, leading to skewness unsmoothness, deformation or breakage of the ribs when opening the umbrella. However, since in the structure provided in said prior art, the inner intermediate main rib is integrally formed with a groove at the outer end for receiving the flexible linkng rib and has the outer end pivotally connected to the outer intermediate main rib, which, while serving the purpose of folding and securely bracing the umbrella, provides insufficient strength. Moreover, while the flexible linking rib with is resiliency assists the umbrella in opening and closing, the resilient nature of the flexible linking rib itself often causes the flexible linking rib to vibrate and become unstable when opening and closing the umbrella, and after long period of use or when the ribs are subject to stronger external force, the linking rib tends to become deformed, twisted and axially extended with the result of weakened resiliency, thus is unable to serve the purpose of having the ribs stretched before the cloth is opened when opening the umbrella and fails to achieve the effect of having sufficient assistance in folding the ribs when closing the umbrella. In consideration of the drawbacks described above, the inventor thought to make improvements and, after continued trying, has finally succeeded.

Accordingly, the main object of the present invention is to provide a rib structure of multiple-fold umbrella having enchanced strength and allowing to be opened and closed more smoothly, characterized essentially in that the outermost end of the inner intermediate main rib is formed into a bifurcated portion within which a back-up joint in U-shaped cross section is pivotally connected for fitting thereunder and the inner end of the outer intermediate main rib is pivotally connected to the back-up joint and the outermost end of the inner intermediate main rib, thereby to increase the strength and stability of the umbrella ribs as a whole.

Another object of the present invention is to provide a rib structure of multiple-fold umbrella in which a back-up resilient part is provided between the inner intermediate main rib and the intermediate linking rib or between the outer intermediate main rib and the outer linking rib such that when opening the umbrella, the ribs are straightened and stretched for smooth unfolding without skewing of the ribs by means of the force of the back-up resilient part acting upon the intermediate and the outer linking ribs, causing the ribs to move in linkage before the umbrella cloth is tensioned and, when closing, the ribs can be folded smoothly.

Other objects and the function of the present invention will become apparent from the following detailed description, taken in conjuction with the accompanying drawings. It is to be appreciated that the following description is used to explain the preferred embodiments of the present invention but not intended to limit the the present invention in any form. Therefore, all modifications or alterations that can be made under similar spirit of the present invention are within the scope as set forth in appended claims. In the drawings:

Figure 1:
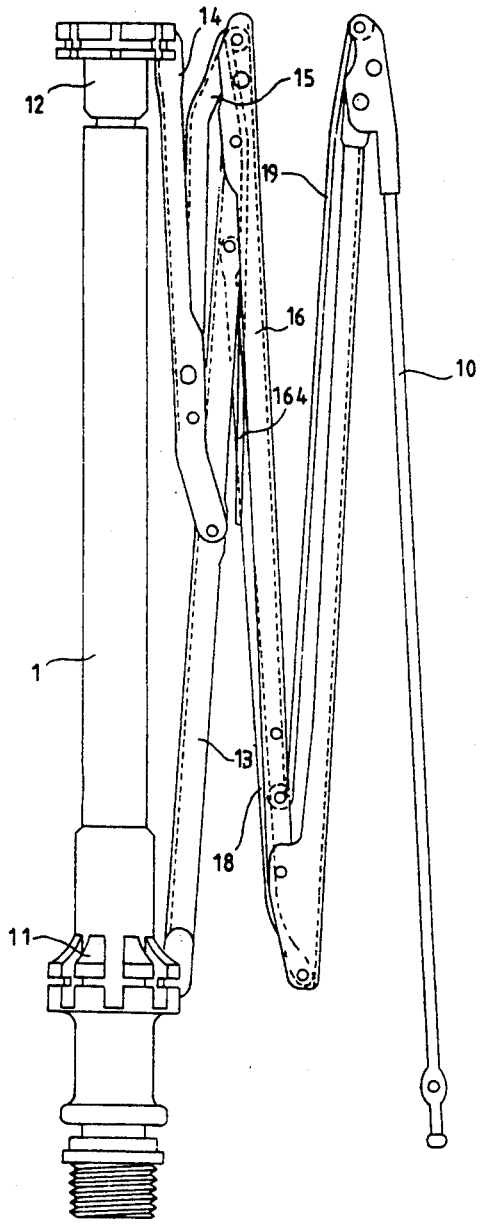
FIG. 1 is a plan view showing the structure of the present invention as a whole in folded condition.
Figure 2:
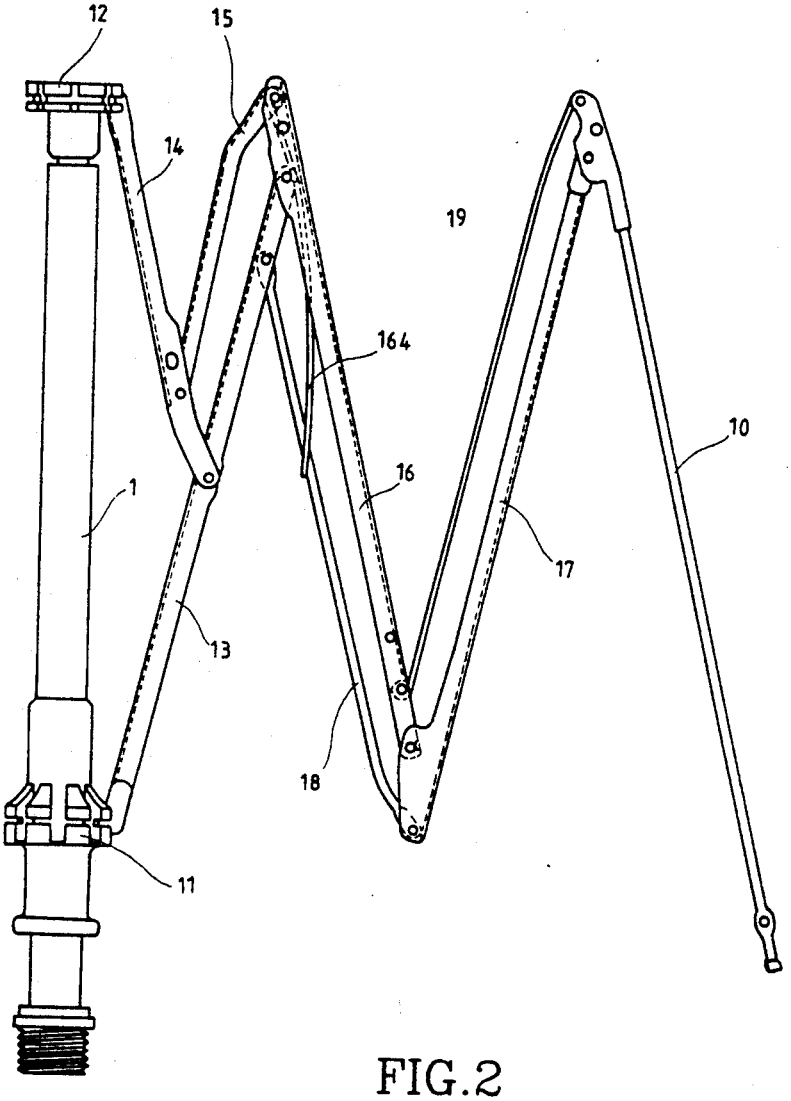
FIG. 2 is a view showing the operation for stretching the the rib structure of the present invention.

As shown in FIGS. 1 and 2, the structure of the present invention generally includes an inner main rib 14 with its inner end pivotally connected to an upper nest 12 of a central shaft 1; an inner stretcher rib 13 with its inner end pivotally connected to a lower nest 11 which is slidably fitted over the central shaft 1 and its intermediate section pivotally connected to the outermost end of the inner main rib 14; an inner linking rib 15 with its inner end pivotally connected to the outer end of the inner main rib 14; an inner intermediate main rib 16 with its innermost end pivotally connected to the outer end of the inner linking rib 15 and its inner end pivotally connected to the outermost end of the inner stretcher rib 13; an outer intermediate main rib 17 with its innermost end pivotally connected to the outer end of an intermediate linking rib 18 and its inner end pivotally connected to the outermost end of the inner intermediate main rib 16; an outer linking rib 19 with its inner end pivotally connected to the outer end of the inner intermediate main rib 16; and an outer main rib 10 with its innermost end pivotally connected to the outer end of the outer linking rib 19 and its inner end pivotally connected to the outer end of the outer intermediate main rib 17.

Figure 3:
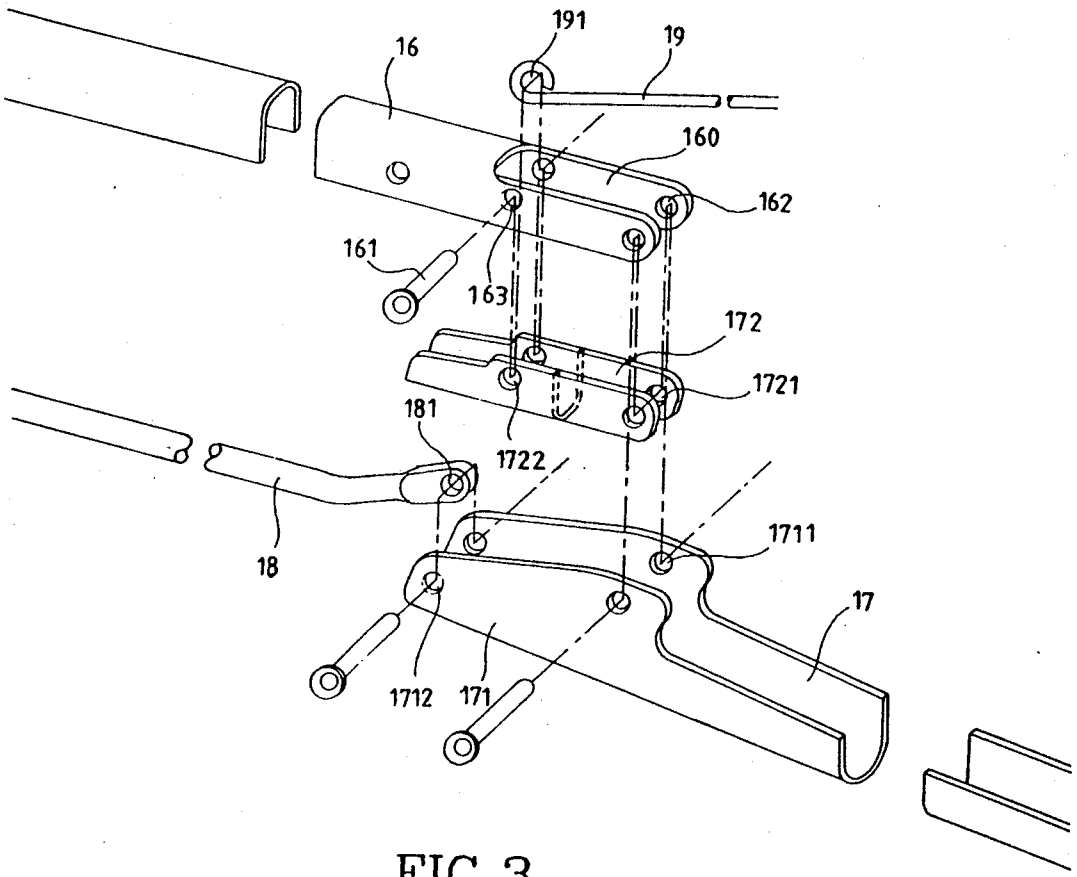
FIG. 3 is an exploded perspective view of the back-up joint provided in the present invention.

As shown in FIG. 3, the structural improvements of the presentinvention are characterized in that the outer end of the inner intermediate main rib 16 is formed with bifurcated portion 160 having only two wall faces with their outermost end and outer end being both provided with holes 162, 163, respectively; that there is further provided a back-up joint 172 of U-shaped cross section with its both sidewalls being each provided with holes 1721, 1722, after being fitted into the bifurcated portion 160 with its groove facing up, the outer linking rib 19 being pivotally connected to the inner intermediate main rib 16 and the back-up joint 172 by having a rivet 161 threaded through the holes 163, 1722 and the pivotal hole 191 at the inner end of the outer linking rib 19 in rotatable manner; and that the outer intermediate main rib 17 is formed with an upwardly-opened groove and its inner end is formed with a fitting portion 171 for pivotally connecting the bifurcated portion 160 of the inner intermediate main rib 16 and the back-up joint 172 provided therein to be fitted into the outer intermediate main rib 17 and pivotally connected by having a rivet threaded through the hole 1711 provided at the inner end of outer intermediate main rib 17 and the hole 1721 at the outer end of the back-up joint 172, the outer intermediate main rib 17 and the intermediate linking rib 18 being pivotally connected to each other by having a rivet threaded through the hole 1722 provided at the inner end and the pivotal hole 181 provided at the outer end of the intermediate linking rib 18. Such a structural configuration serves to increase the strength of the outer end of the inner intermediate main rib 16 such that after opening the umbrella, optimal stability can be achieved for extended service life.

Figures 4, 4A, 4B:
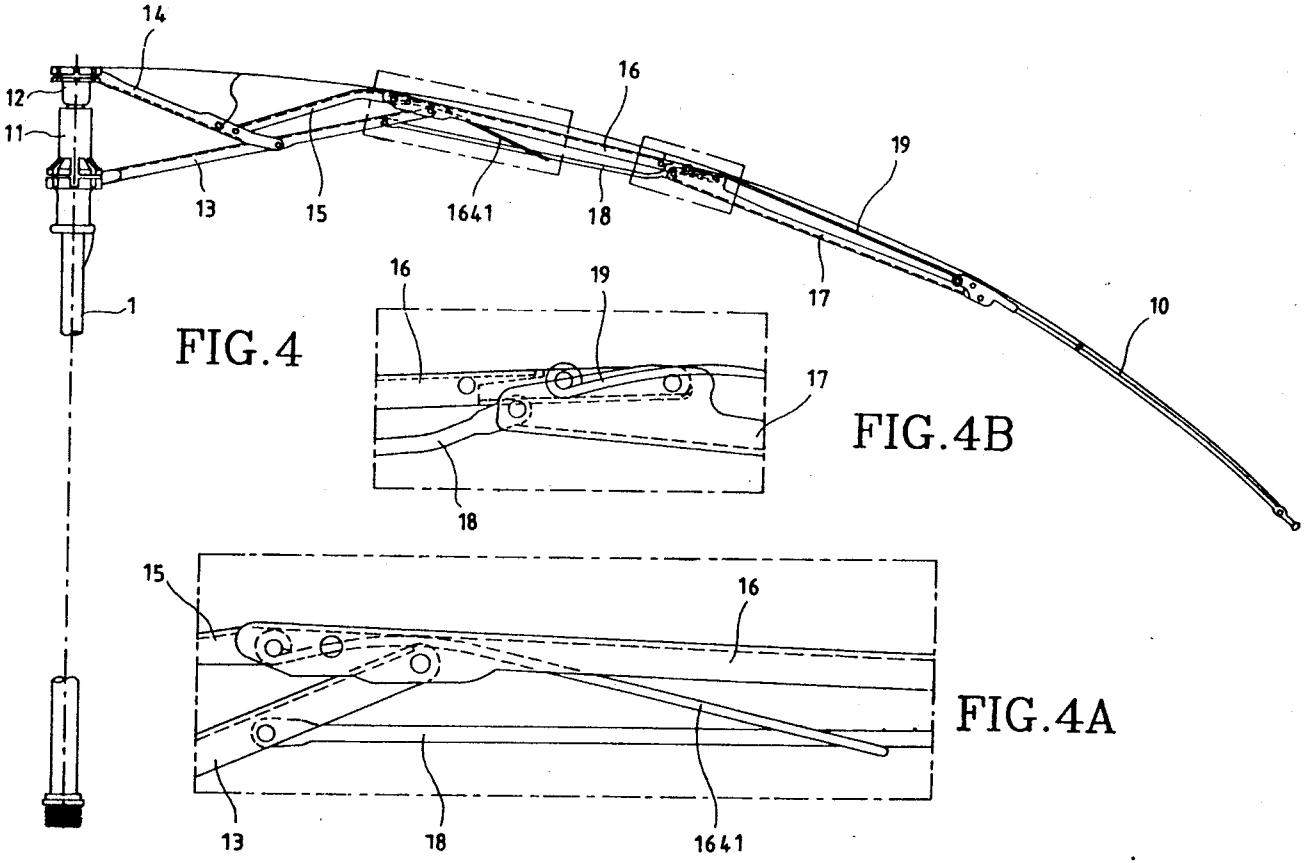
FIG. 4 is a plan view showing the back-up resilient part provided in the present invention after being fully stretched.
FIG. 4A is fragmentary plan view showing the relative position of the back-up resilient part shown in FIG. 4;.
FIG. 4B is fragmentary plan view showing the relative position of the outer linking rib, the outer intermediate main rib, the intermediate linking rib, the inner intermediate main rib and the back-up joint shown in FIG. 4;.

Further, as shown in FIGS. 4 and 4A, another improvement according to the present invention is characterized in that the intermediate linking rib 18 is made from a material of adequate rigidity in the shape of a straight rod for optimal strength when the ribs are stretched open and that there is further provided a back up resilient part joined at relevant postions between the inner intermediate main rib 16, the inner linking rib 15, the inner stretcher rib 13, and the intermediate linking rib 18 such that when opening or closing the umbrella, the inner intermediate main rib 16 and the inner linking rib 15 are opened before the cloth is fully opened and then the cloth is stretched open, thus to facilitate the operation of opening the umbrella without the risk of deforming the umbrella ribs even after extended period of use.

Figure 5:
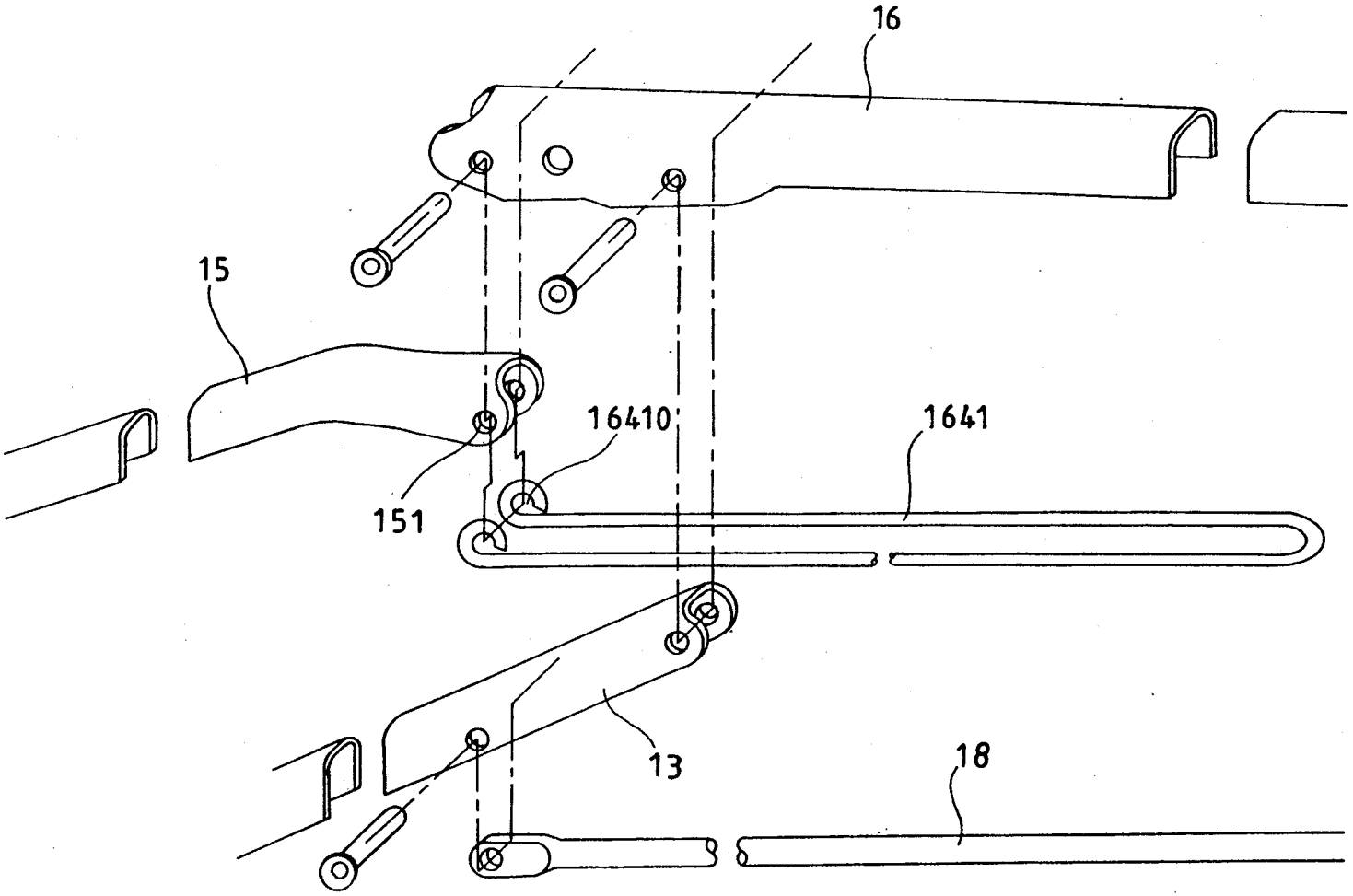
FIG. 5 is an exploded perspective view showing the back-up resilient part provided in the present invention.

As shown in FIG. 5, the back-up resilient part 1641 of the the present invention is made from a resilient material integrally bent into a U-shaped configuration with its both ends being wound into pivotal holes 16410 and pivotally connected by having a rivet threaded through the hole 151 provided at the outer end of the inner linking rib 15 and the pivotal holes 16410 of the back-up resilient part 1641. The intermediate linking rib 18 is threaded through the U-shaped groove of the back-up resilient part 1641 and comes to ride over the U-shaped bend and the outer end of the inner stretcher rib 13 is pressed against an appropriate point in the intermediate section of the back-up resilient part 1641, causing the bend of the back-up resilient part 1641 to exert resilient force upon the intermediate linking rib 18 such that when opening the umbrella to stretch the ribs, by means of the upward resilient force exerted upon the intermediate linking rib 18, the links are moved in an interlinked manner to increase the stretching speed for smooth umbrella opening. Moreover, the intermediate linking rib 18 is compressed upwardly by the back-up resilient part 1641 and thus obtains downward resilient force in the stretching process such that when closing the umbrella, the resilient force is released for quick folding with the result of quite smooth umbrella closing.

Figures 6, 6A:
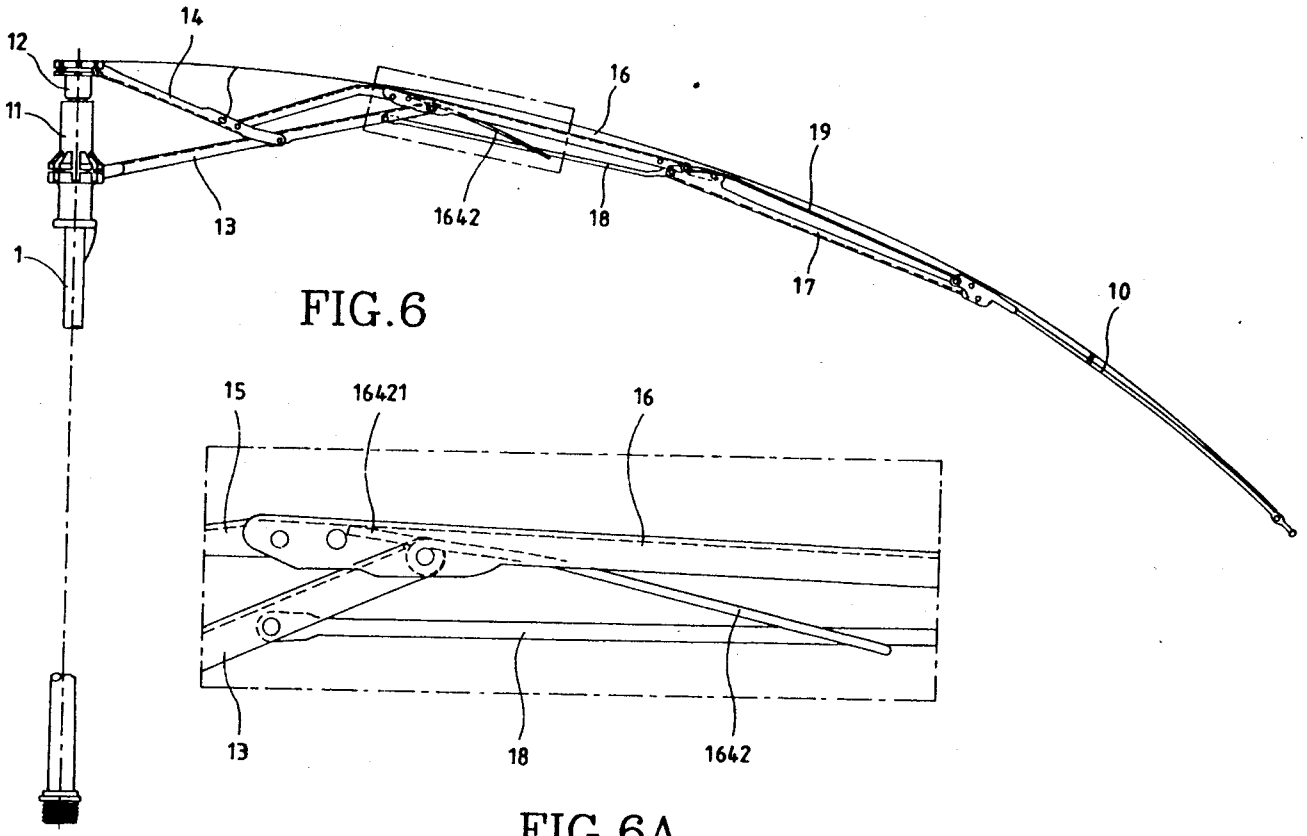
FIG. 6 is an exploded perspective view showing another embodiment of the back-up resilient part of the the present invention.
FIG. 6A is an enlarged view showing the position of the back-up resilient part shown in FIG. 6.
Figure 7:
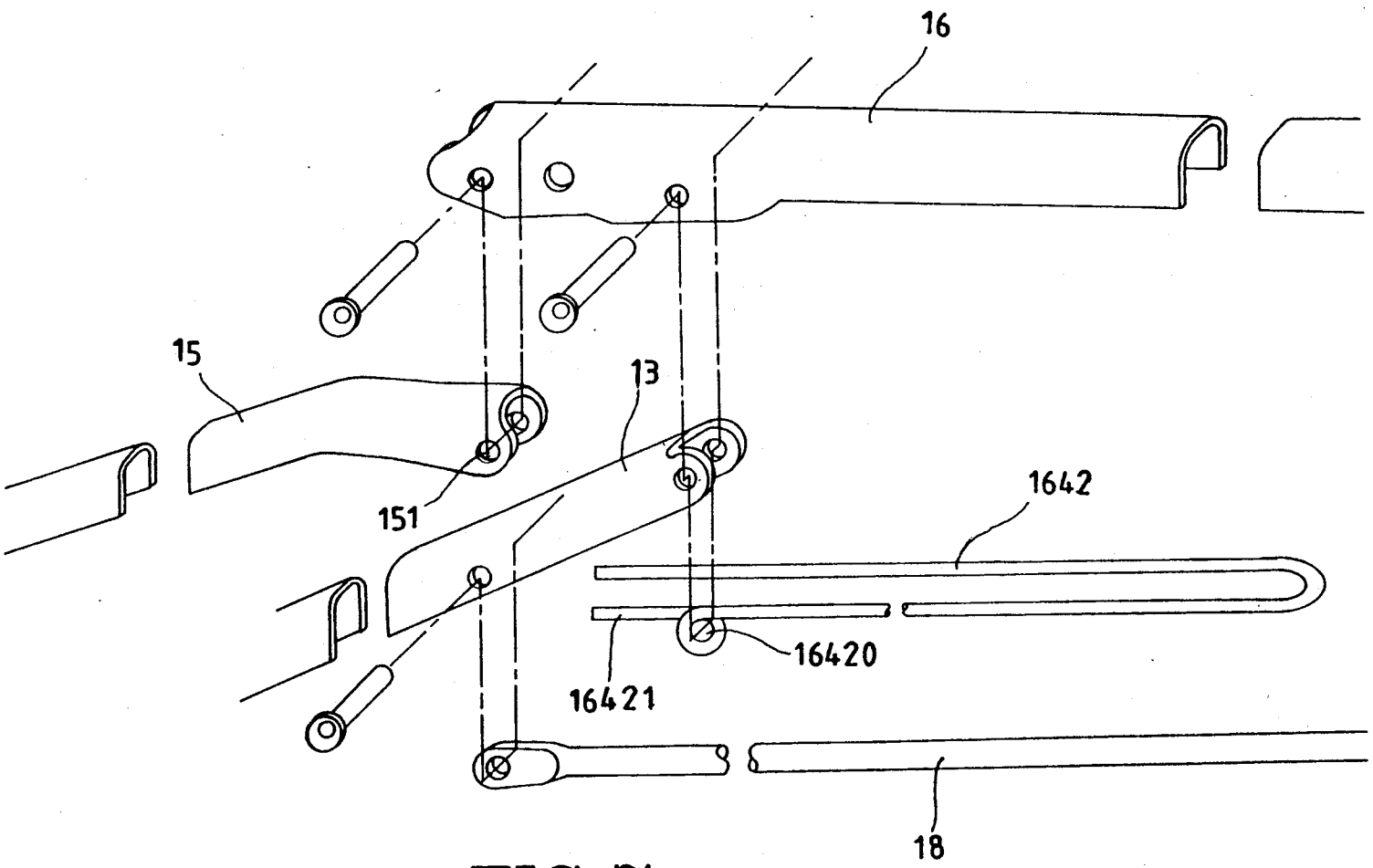
FIG. 7 is an exploded perspective view showing the structural configuration shown in FIG. 6A.

As shown in FIGS. 6, 6A, and 7, the back-up resilient part 1642 of the the present invention can also be made from a resilient material and integrally formed into a U-shaped configuration, the intermediate section of its one side being wound into a pivotal hole 16420 at an appropriate point for pivotally fitting to the outer end of the inner stretcher rib 13 and inner end of the inner intermediate main rib 16 by means of a rivet, and the end portion adjacent the pivotal hole 16420 being formed with a relatively short abutting portion 16421, after being pivotally fitted, the back-up resilient part 1642 pressing the abutting portion 16421 against the inner upper face of the inner intermediate main rib 16 as a fulcrum. The intermediate linking rib 18 is threaded through the U-shaped groove formed by the back-up resilient part 1642 and thus obtains upward resilient force such that when opening the umbrella, the links are moved in an interlinked manner to increase the stretching speed for smooth umbrella opening. Moreover, the intermediate linking rib 18 is compressed upwardly by the back-up resilient part 1642 and thus obtains downward resilient force in the stretching process such that when closing the umbrella, the resilient force is released for quick folding with the result of quite smooth umbrella closing.

Figure 8:
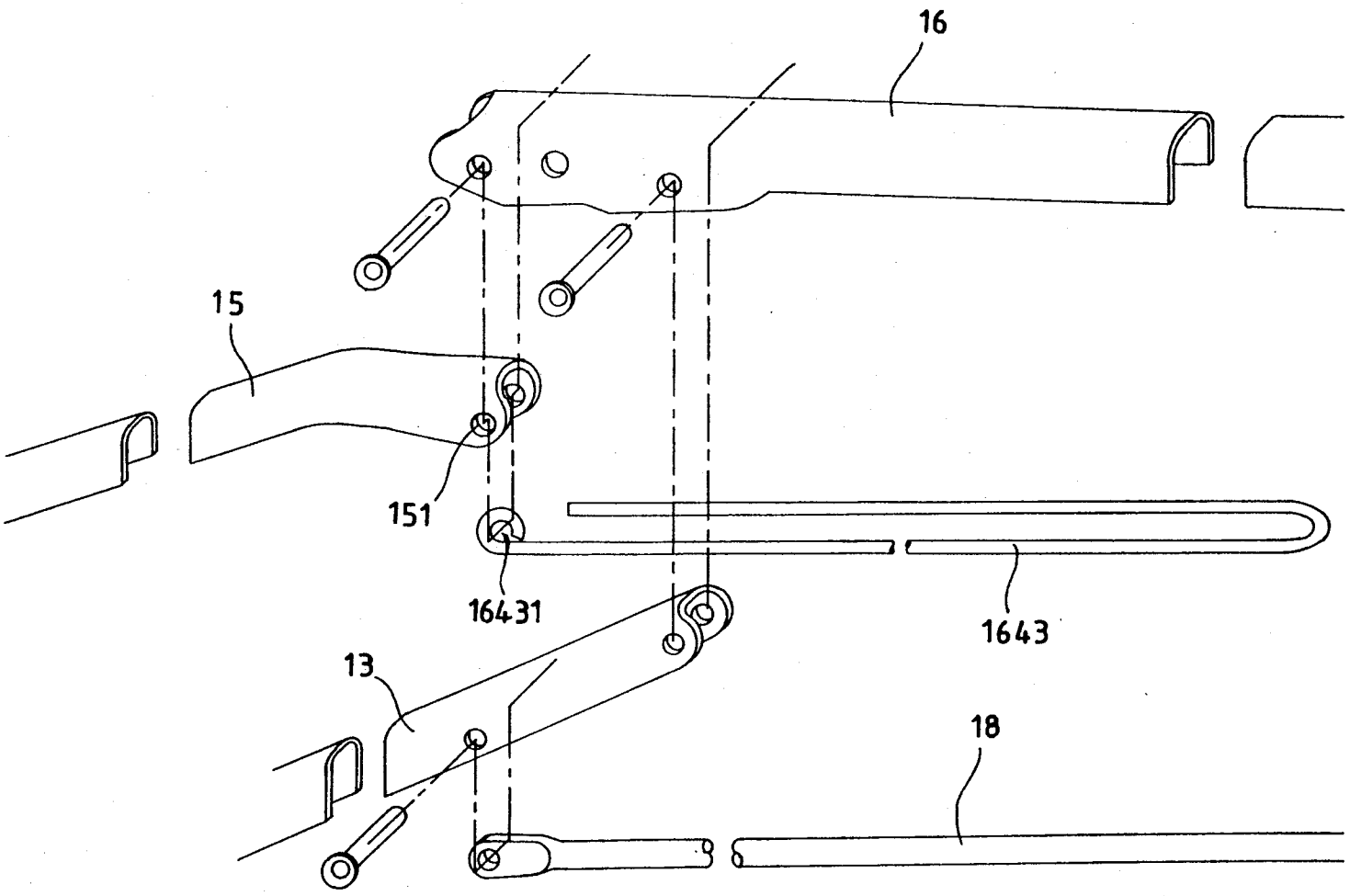
FIG. 8 is is a view showing another embodiment of the back up resilient part provided in the present invention.

As shown in FIG. 8, the back-up resilient part 1643 of the the present invention can also made from a resilient material and integrally formed into a U-shaped configuration having only one end wound into a pivotal hole 16431 for pivotal connection. The arrangement of the pivotal connection and the manner in which the pivotal connection is made are the same as those described above.

Figures 9, 9A:
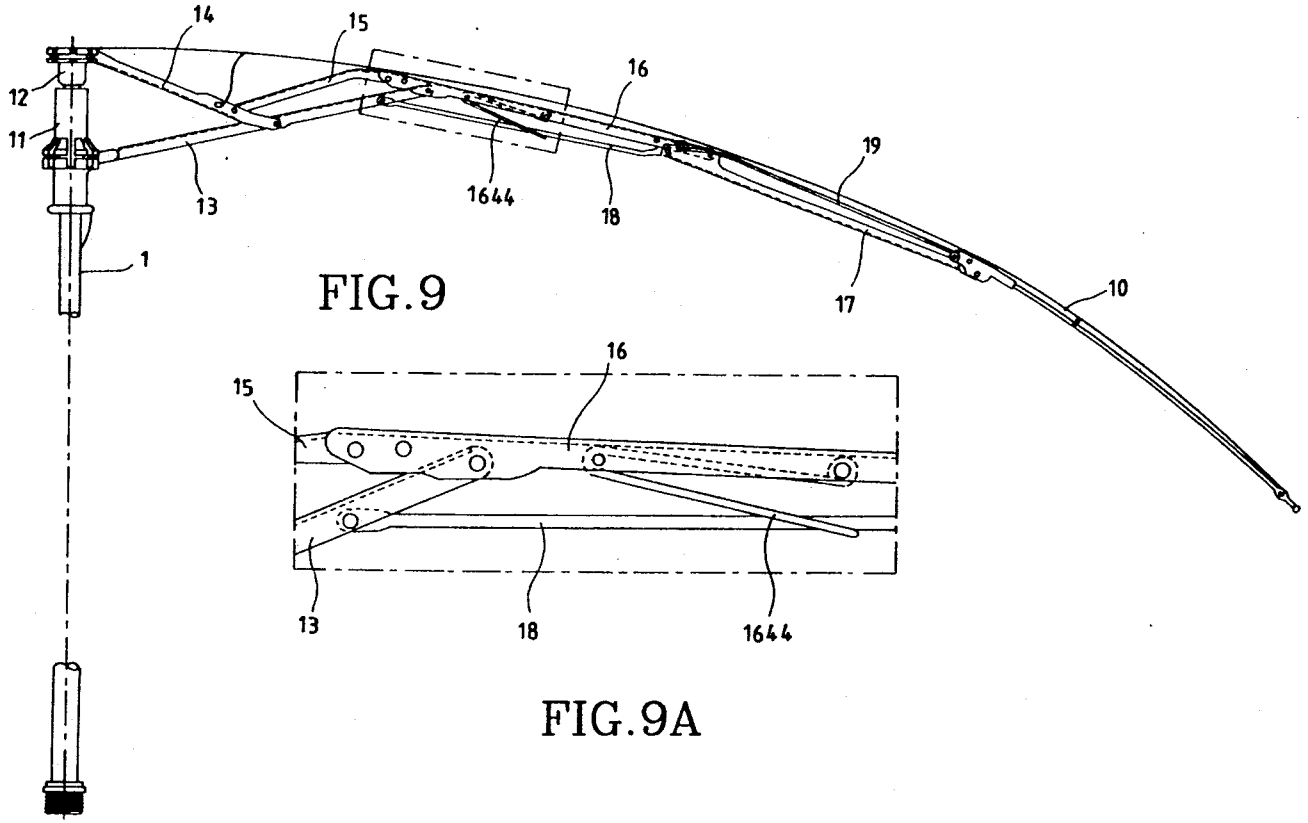
FIG. 9 is is a view showing another embodiment of the back up resilient part provided in the present invention.
FIG. 9A is an enlarged view showing the back-up resilient part shown in FIG. 9.
Figure 10:
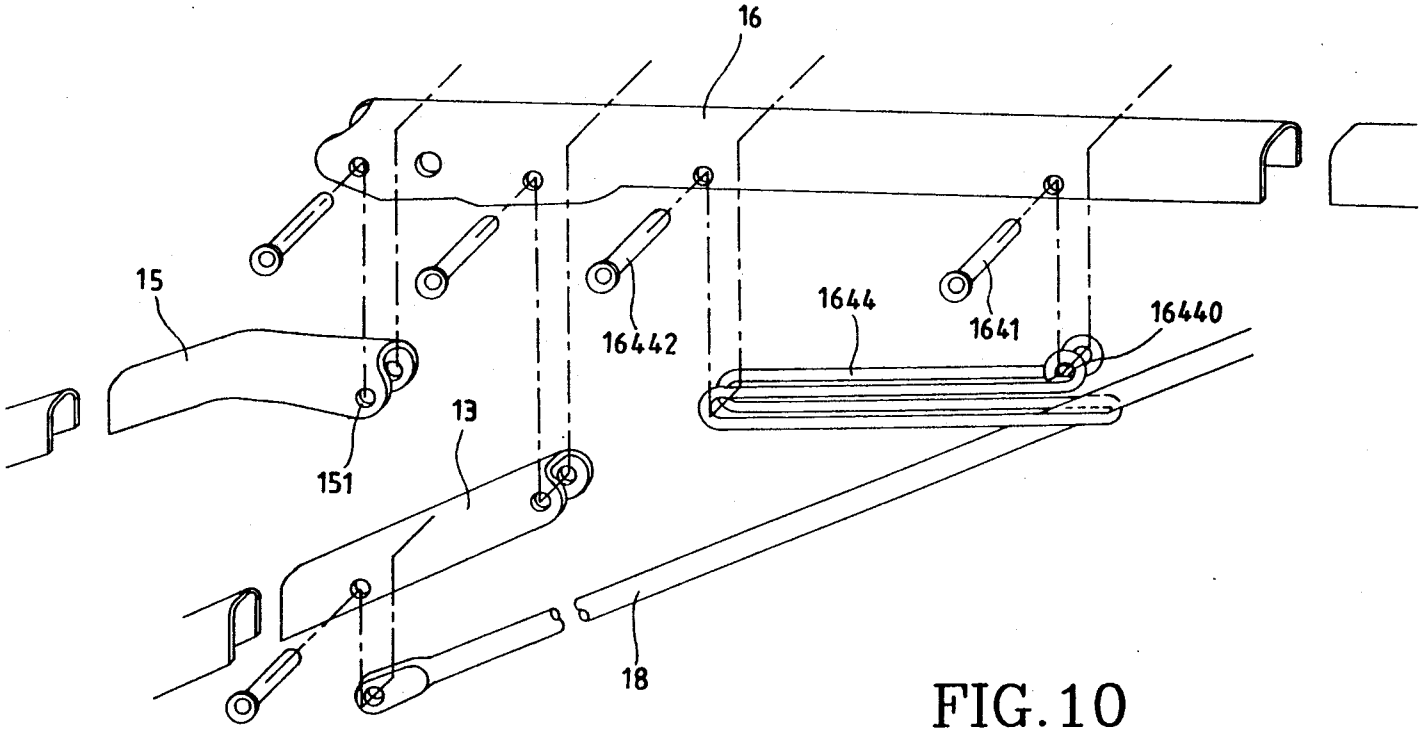
FIG. 10 is an exploded perspective view showing the structural configuration shown in FIG. 9A.

As shown in FIGS. 9, 9A, and 10, the back up resilient part 1644 of the present invention can also be made from a resilient material and integrally formed into a double U-shaped configuration with both of its unclosed ends formed into pivotal holes 16440. A pivotal stud 16441 is threaded through the pivotal holes 16440 of the back-up resilient part 1644 to be pivotally connected at an appropriate point in the intermediate section of the inner intermediate main rib 16 and the bend of this back-up resilient part 1644 is fitted over a protruded post 16442 previously provided in the inner intermediate main rib 16. In addition, the intermediate linking rib 18 is threaded through the U shaped groove bent on the back up resilient part 1644 and comes to ride thereover such that force is exerted between the inner intermediate main rib 16 and the intermediate linking rib 18, causing them to approach each other for smoother opening and closing of the umbrella.

Figures 11, 11A:
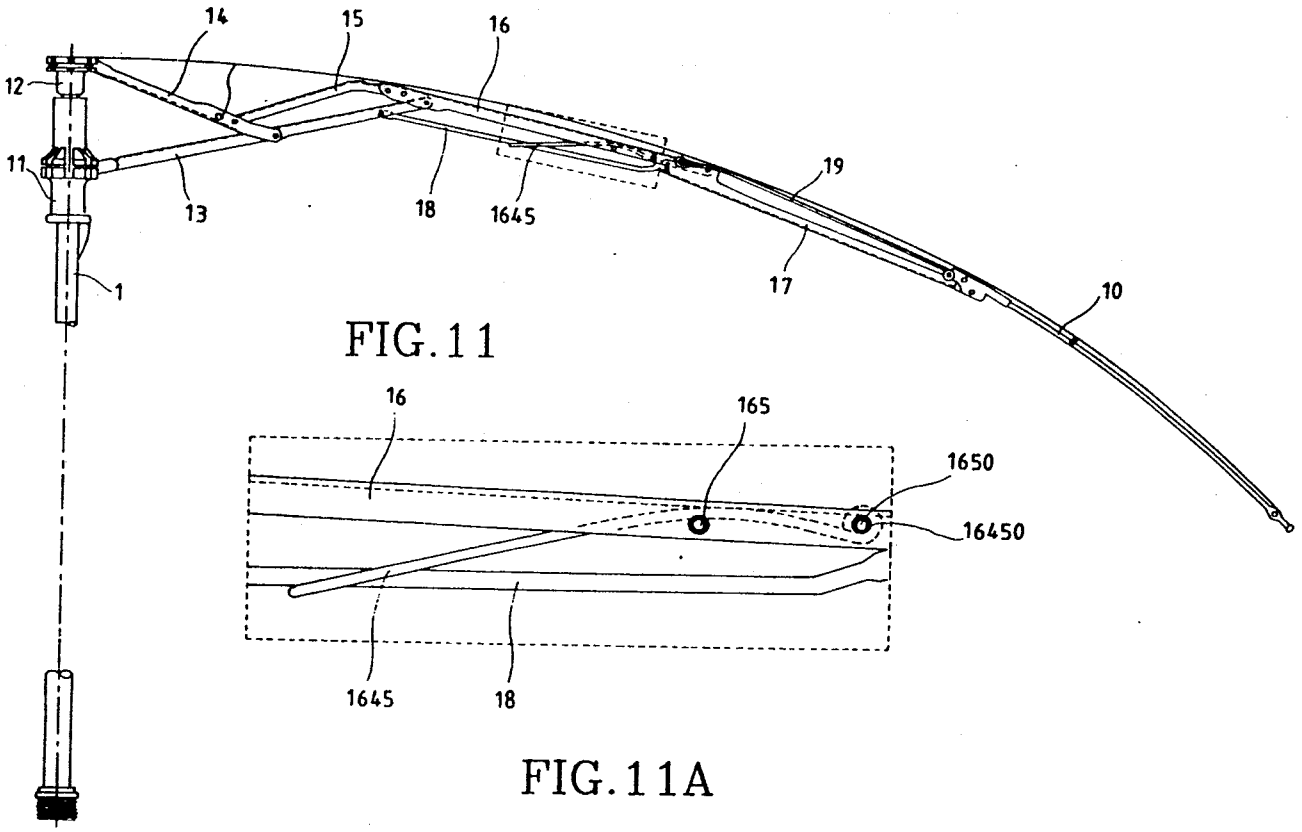
FIG. 11 is a view shown another embodiment of the back-up resilient part provided in the present invention.
FIG. 11A is an enlarged view showing the back-up resilient part shown in FIG. 11.

As shown in FIGS. 11 and 11A, the back-up resilient part 1645 of the present invention can also be made from a resilient material and integrally formed into a single U-shaped configuration with both of its ends formed with a pivotal hole 16450 for pivotal fitting over a pivotal stud 1650 previously provided in the inner intermediate main rib 16 and the back-up resilient part 1645 rides over a protruded post 165 previously provided on the inner intermediate main rib 16. The intermediate linking rib 18 is threaded through the U-shaped groove formed by the back-up resilient part 1645 and thus obtains upward resilient force such that when opening the umbrella, the links are moved in an interlinked manner to increase the stretching speed for smooth umbrella opening. Moreover, the intermediate linking rib 18 is compressed upwardly by the back-up resilient part 1645 and thus obtains downward resilient force in the stretching process such that when closing the umbrella, the resilient force is released for quick folding with the result of quite smooth umbrella closing.

Figures 12, 12A:
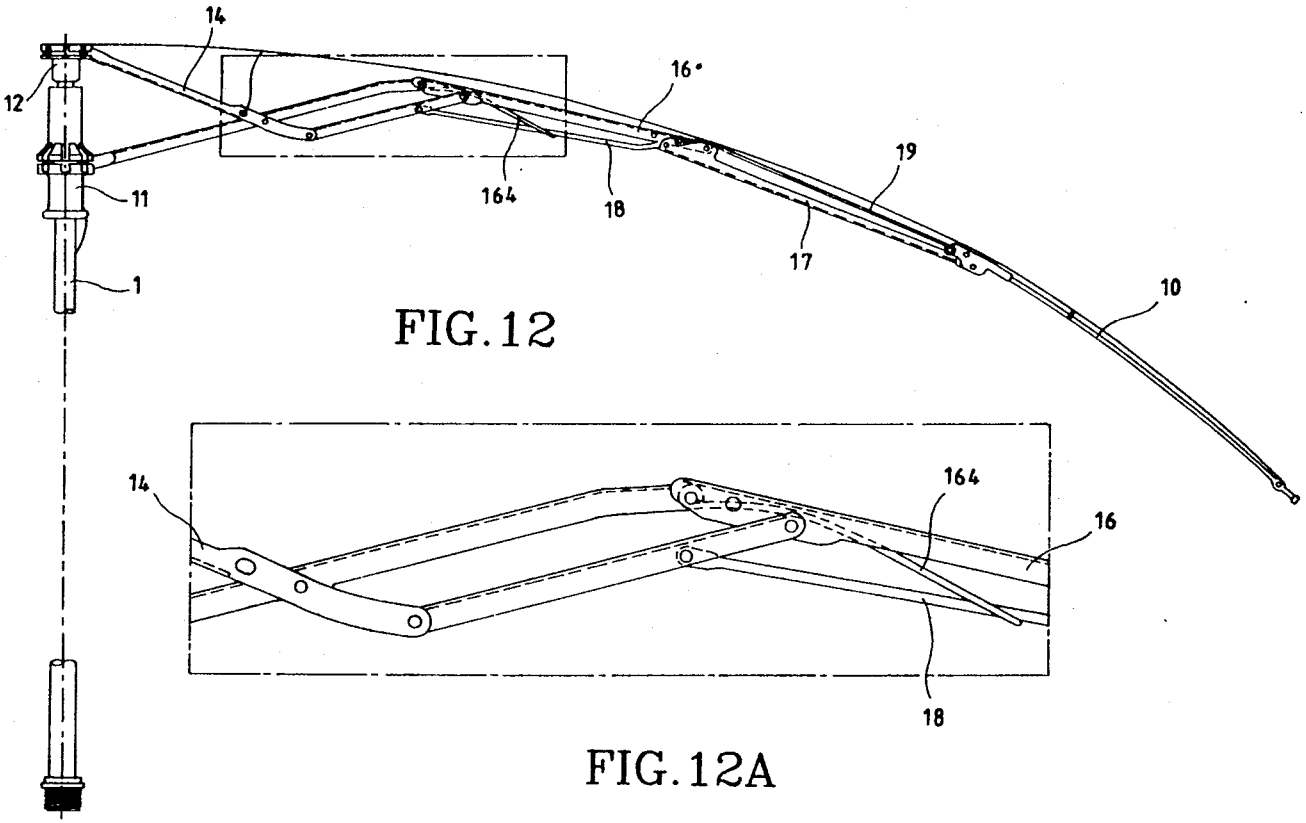
FIG. 12 is a view showing an embodiment in which the back-up resilient part and the back-up joint in the structure shown in FIGS. 1 to 4 can be utilized in crossed type ribs.
FIG. 12A is an enlarged view showing the back-up resilient part shown in FIG. 12.

As shown in FIGS. 12 and 12A, the structure described above is not limited only to ribs of non-crossed configuration, but they can be utilized in those having crossed ribs and arranged in the same manner for the same effect.

Figures 13, 13A:
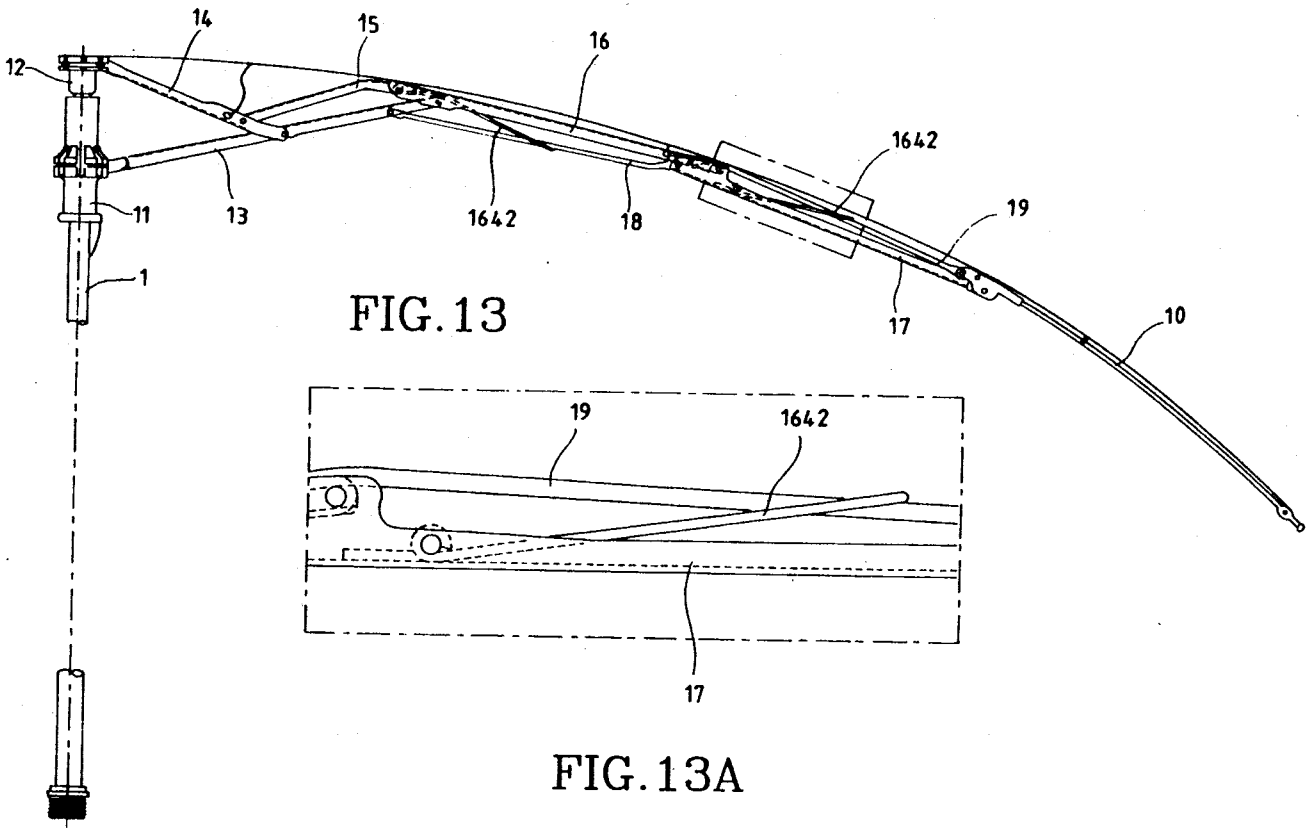
FIG. 13 is is a view showing another embodiment of the back-up resilient part provided in the present invention.
FIG. 13A is an enlarged view showing the back-up resilient part shown in FIG. 13.
Figure 14:
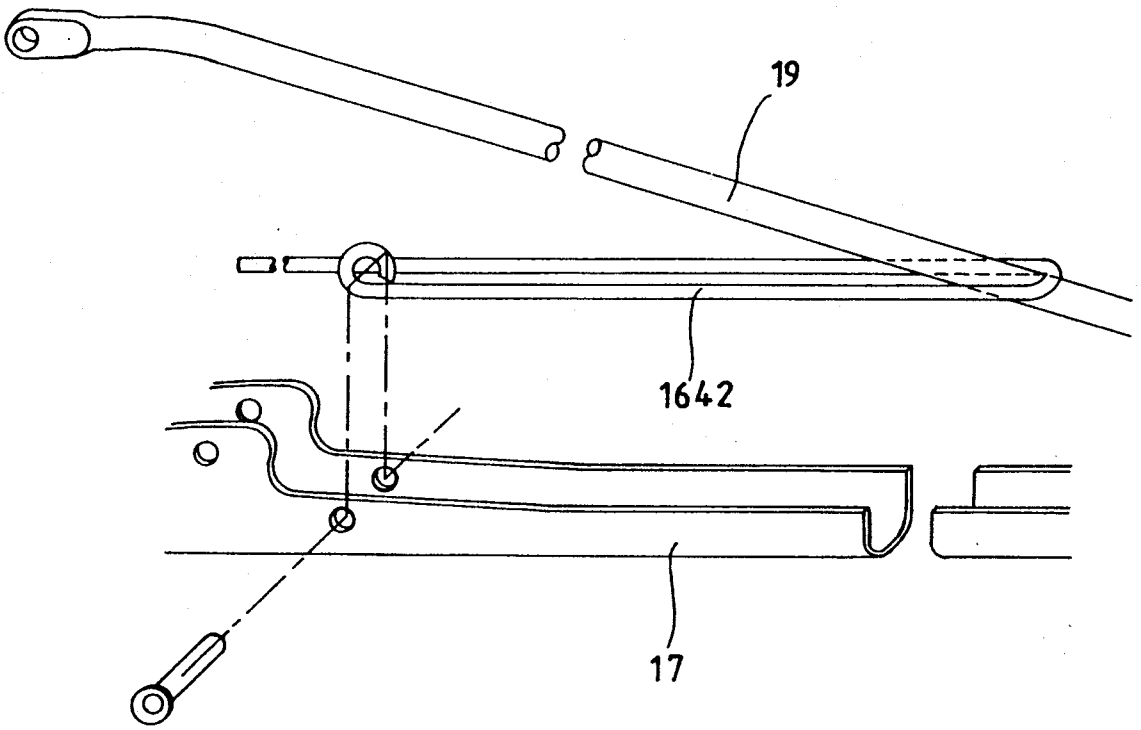
FIG. 14 is an exploded perspective view showing the structural configuration shown in FIG. 13A.
Figure 15:
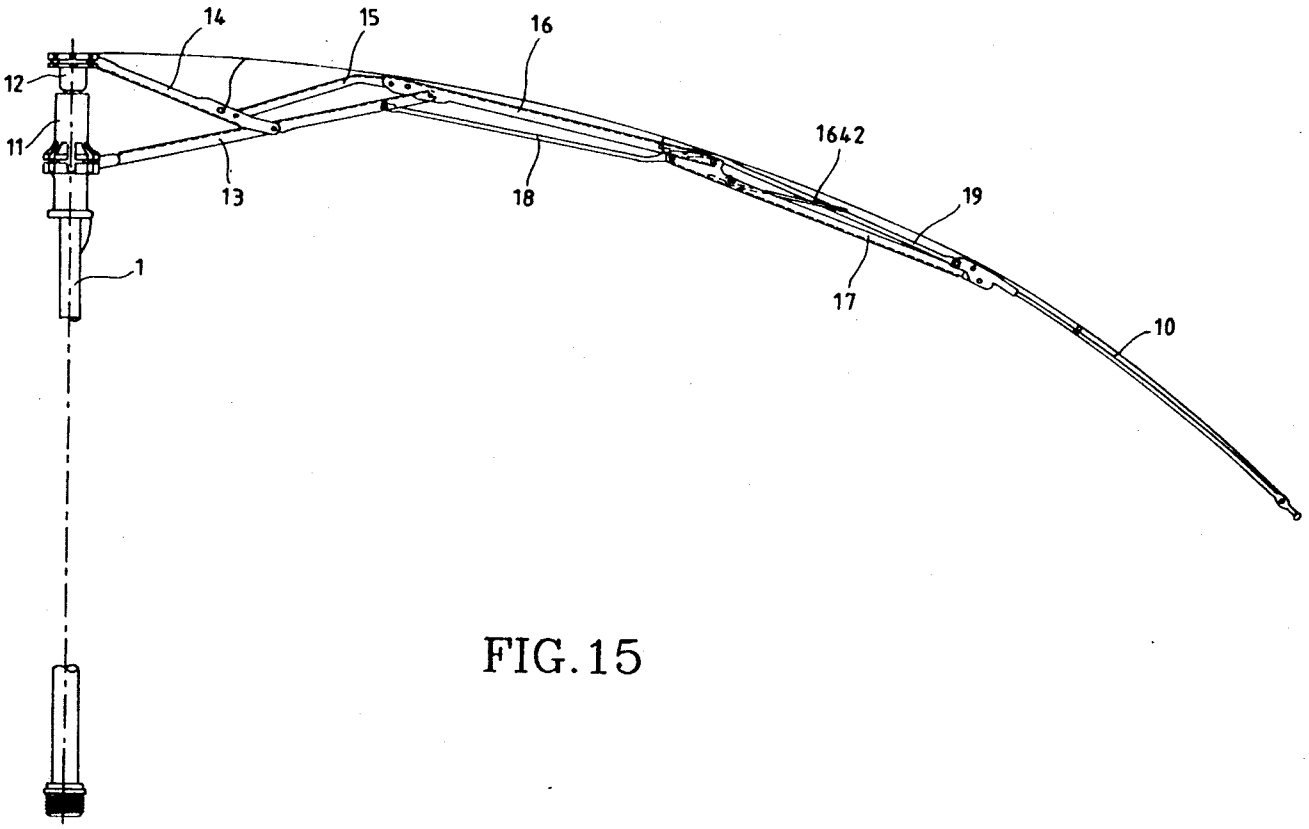
FIG. 15 is a view showing an embodiment in which the back-up resilient part is provided in a different position to achieve the same effect.
Figure 16:
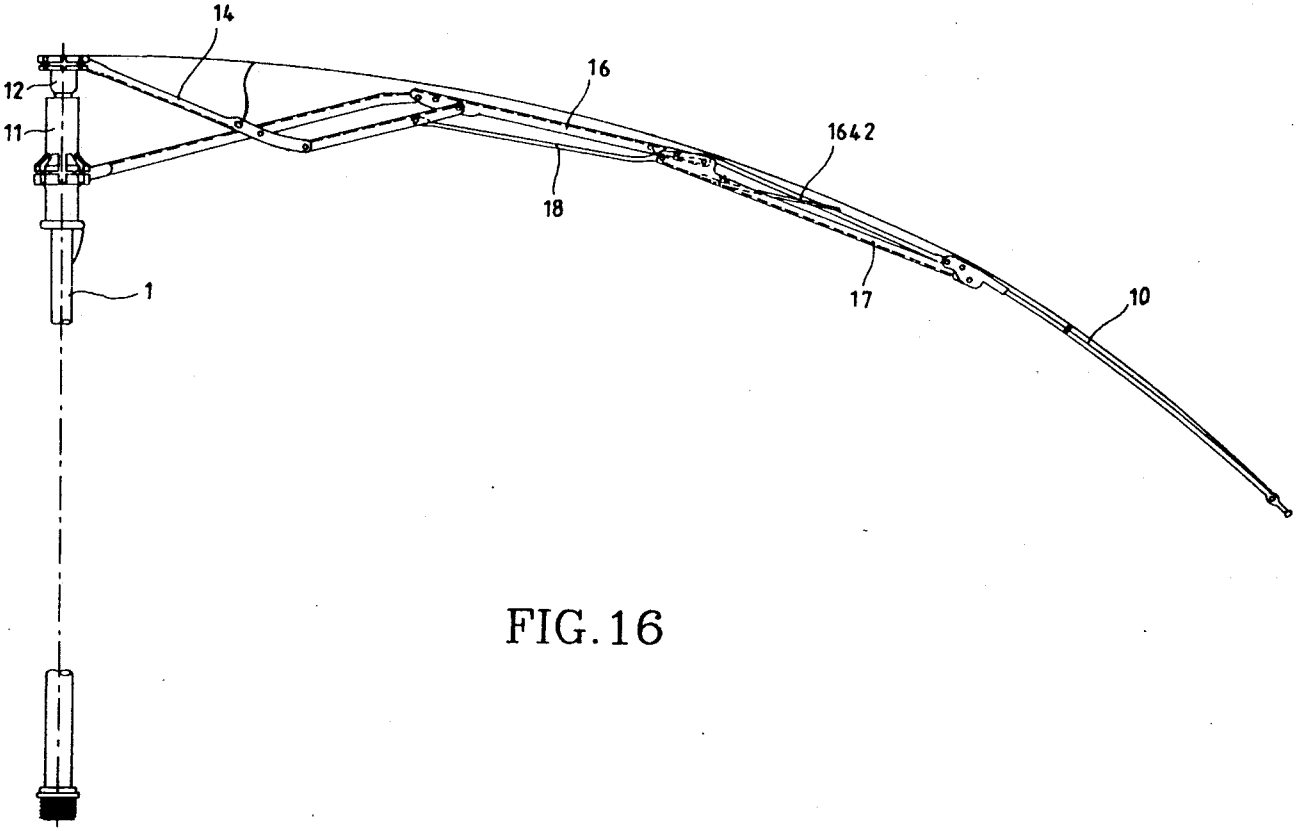
FIG. 16 is a view showing an embodiment in which the back-up resilient part shown in FIGS. 15 can be utilized in crossed type ribs.
Figure 17:
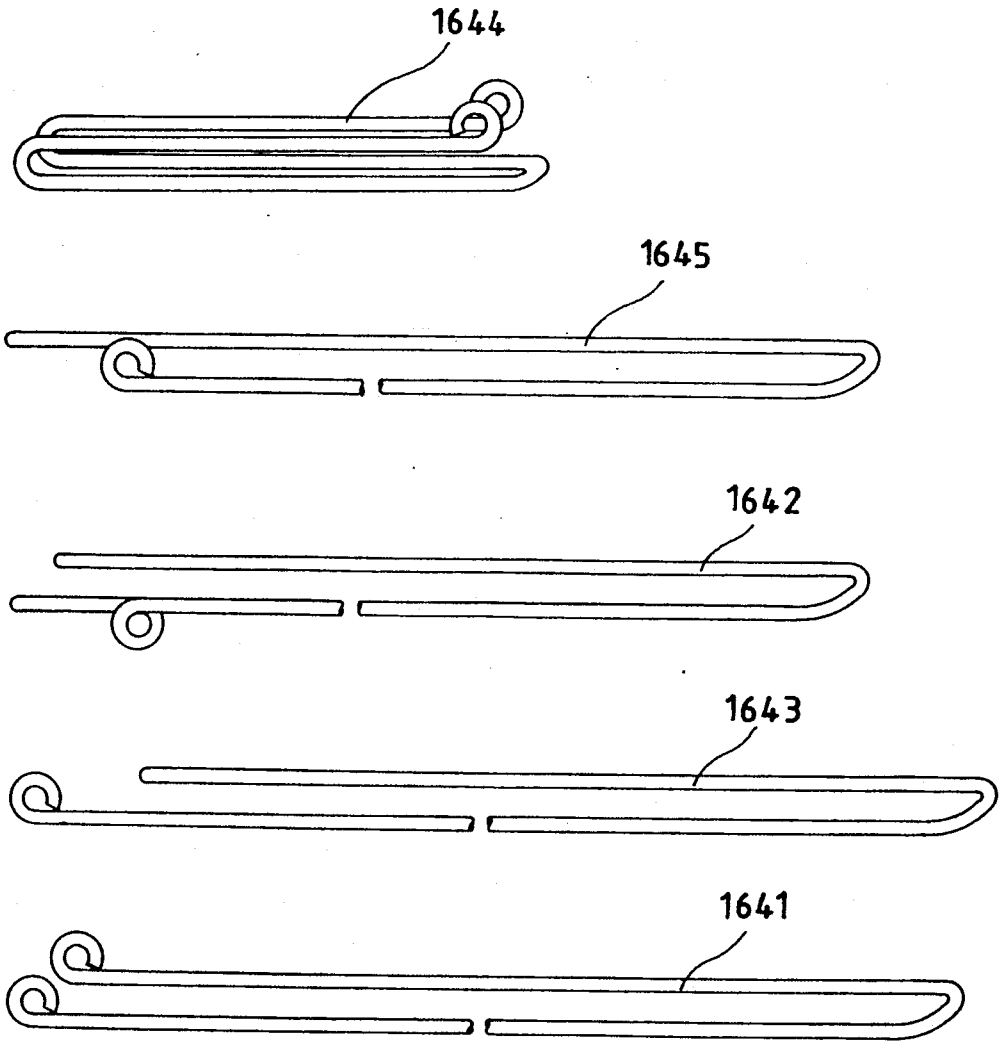
FIG. 17 shows the various configurations of the back-up resilient part that can be utilized in the present invention.

As shown in FIGS. 13, 13A, and 14, according to the present invention, the back-up resilient part 1642 can be further pivotally provided in the outer intermediate main rib 17. The 10 is threaded through the U-shaped groove formed by the back-up resilient part 1642 and comes to ride over the outer intermediate main rib 17 such that when opening the umbrella, the outer linking rib 19 is pressed by the resilient force of the back up resilient part 1642 for the same effect of smooth umbrella opening and closing. In addition, the back-up resilient part 1642 can be provided directly in this portion instead of having the back-up resilient part provided in the regions of the inner stretcher rib 13 and the inner intermediate main rib 16 (as shown in FIG. 15), and such structures can be used for configuration with crossed ribs (as shown in FIG. 16) such that they are suitable for even wider range of applications.

From the foregoing, it is apparent that the present invention is considered novel and practical in effectiveness, and does overcome the disadvantages found in conventional prior art. Therefore, the present invention is in conformity with the essential provisions as set forth in the Patent Law and patent application is hereby submitted for your approval in accordance with the Law.

What is claimed is:

1. A rib structure of multiple-fold umbrella comprising: an inner main rib with its inner end pivotally connected to an upper nest of a central shaft; an inner stretcher rib with its inner end pivotally connected to a lower nest which is slidably fitted over the central shaft and its intermediate section pivotally connected to the outermost end of the inner main rib; an inner linking rib with its inner end pivotally connected to the outer end of the inner main rib; an inner intermediate main rib with its innermost end pivotally connected to the outer end of the inner linking rib and its inner end pivotally connected to the outermost end of the inner stretcher rib; an outer intermediate main rib with its innermost end pivotally connected to the outer end of an intermediate linking rib and its inner end pivotally connected to the outermost end of the inner intermediate main rib; an outer linking rib with its inner end pivotally connected to the outer end of the inner intermediate main rib; and an outer main rib with its innermost end pivotally connected to the outer end of the outer linking rib and its inner end pivotally connected to the outer end of the outer intermediate main rib; characterized in that: the outer end of the inner intermediate main rib is formed into a bifurcated portion within which a back-up joint in U-shaped cross section is pivotally connected for fitting thereover and the inner end of the outer intermediate main rib is pivotally connected to the back-up joint and the outermost end of the inner intermediate main rib, thereby to increase the strength of the umbrella ribs; and that the intermediate linking rib is made from a non-flexible material of in the shape of a rod with its ends pivotally connected to the outer end of the inner stretcher rib and the innermost end of the outer intermediate main rib, respectively a back-up resilient part being provided between the inner intermediate main rib and the intermediate linking rib or between the outer intermediate main rib and the outer linking rib such that when opening the umbrella, the ribs are straightened and stretched for smooth unfolding without skewing of the ribs by means of the force of the back-up resilient part acting upon the intermediate or the outer linking ribs, causing the ribs to move in linkage before the umbrella cloth is tensioned and, when closing, the ribs can be folded smoothly.

2. The rib structure of multiple-fold umbrella as set forth in claim 1 in which the back-up resilient part is made from a resilient material and integrally bent into a U-shaped configuration with its both ends being formed with pivotal hole for pivotally fitting over the pivotal studs of the inner linking rib and the inner intermediate main rib; the intermediate linking rib is threaded through the U-shaped groove of the back-up resilient part and comes to ride over the U-shaped bend; and the outer end of the inner stretcher rib is pressed against an appropriate point in the intermediate section of the back-up resilient part, causing the bend of the back-up resilient part to exert resilient force upon the intermediate linking rib.

3. The rib structure of multiple-fold umbrella as set forth in claim 1 in which the back-up resilient part is made from a resilient material and integrally formed into a U-shaped configuration with its one end formed into a pivotal hole for pivotally fitting over the studs of the inner linking rib and the inner intermediate main rib, the intermediate linking rib is threaded through the U-shaped groove formed by the back-up resilient part and comes to ride over the U-shaped bend; and the outer end of the inner stretcher rib is pressed against an appropriate point in the intermediate section of the back-up resilient part, causing the bend of the back-up resilient part to exert resilient force upon the intermediate linking rib.

4. The rib structure of multiple-fold umbrella as set forth in claim 3 in which the back up resilient part is made from a resilient material and integrally formed into a a double U-shaped configuration with both of its ends being formed with pivotal holes for pivotally fitting over the pivotal stud of the inner intermediate main rib and the bend of this back-up resilient part being fitted over a protruded post previously provided in the inner intermediate main rib; and the intermediate linking rib being threaded through the U shaped groove bent on the back-up resilient part and comes to ride thereover such that force is exerted between the inner intermediate main rib and the intermediate linking rib causing them to approach each other for smoother opening and closing of the umbrella.

5. The rib structure of multiple-fold umbrella as set forth in claim 3 in which the back-up resilient part is made from a resilient material and integrally formed into a single U-shaped configuration with both of its ends being formed with a pivotal hole for pivotal fitting over a pivotal stud previously provided in the inner intermediate main rib and the back-up resilient part riding over a protruded post previously provided on the inner intermediate main rib; the resilient part the intermediate linking rib is threaded through the U-shaped groove bent on the back-up resilient part and comes to ride thereover such that force is exerted between the inner intermediate main rib and the intermediate linking rib causing them to approach each over for smoother opening and closing of the umbrella.

6. The rib structure of multiple-fold umbrella as set forth in claim 1 in which the back-up resilient part is made from a resilient material and integrally formed into a U-shaped configuration, a pivotal hole being wound at an appropriate point for pivotally fitting to the outermost end of the inner stretcher rib and stud the inner intermediate main rib, and being extended with an abutting portion; and the intermediate linking rib is threaded through the U shaped groove formed by the back-up resilient part and pressing the abutting portion against the inner upper portion of the inner intermediate main rib.

7. The rib structure of multiple-fold umbrella as set forth in claim 1 in which the back-up resilient part in the configurations of U-shape, double U-shape, and single U-shape can all be disposed between the outer intermediate main rib and the outer linking rib for the same effect.

* * * * *